US005314097A

United States Patent [19]

Smrt et al.

[11] Patent Number: 5,314,097

[45] Date of Patent: May 24, 1994

[54] LONG DISTANCE MARKING DEVICES AND RELATED METHOD

[75] Inventors: Thomas J. Smrt, Marengo; Walter S. Mierzwinski, Schaumburg, both of Ill.

[73] Assignee: Fox Valley Systems, Inc., Cary, Ill.

[21] Appl. No.: 512,882

[22] Filed: Apr. 23, 1990

[51] Int. Cl.[5] ..... B65D 83/00

[52] U.S. Cl. ..... 222/402.1; 424/45; 424/47; 239/337; 239/573; 222/394; 222/527

[58] Field of Search ..... 424/45, 47; 239/337, 239/573; 222/394, 527, 402.1

[56] References Cited

U.S. PATENT DOCUMENTS

| | | | |
|---|---|---|---|
| 3,698,645 | 10/1972 | Coffey | 239/573 |
| 4,080,481 | 3/1978 | Dillenschneider | 239/337 |
| 4,439,342 | 3/1984 | Albanese | 424/45 |
| 4,981,677 | 1/1991 | Thau | 424/47 |

*Primary Examiner*—Thurman K. Page
*Assistant Examiner*—William E. Benston, Jr.
*Attorney, Agent, or Firm*—Leydig, Voit & Mayer, Ltd.

[57] ABSTRACT

The present invention provides a device and method for propelling liquids to long distances. The invention is especially useful for marking animals such as sheep for identification purposes. The device itself comprises a container, liquid residing within said container, gas propellant residing within said container, means comprising an inlet and an outlet for controlling the discharge of said liquid from said container, said means being biased in a closed position and being movable to an open position in response to external pressure thereto, wherein the inlet of said means is in communication with said container, and a tube through which said liquid exits said device in communication with the outlet of said discharge means, said tube extending outwardly from said outlet, wherein the combination of said discharge means, said tube, and said propellant are adapted for discharging said liquid as a liquid stream to a distance of from about ten to about twenty-five feet when said discharge means is moved into the open position. The discharged liquid used in the device and method is also nonflammable according to CSMA and Consumer Product Safety Commission standards.

22 Claims, 4 Drawing Sheets

LONG DISTANCE MARKING DEVICES AND RELATED METHOD

FIELD OF THE INVENTION

The present invention relates to a device and method for discharging liquids, preferably marking compositions, over relatively long distances. More particularly, it contemplates a spraying apparatus and method which allow discharge of a liquid marking composition as a liquid stream from a pressurized container to distances of up to about twenty-five feet.

BACKGROUND OF THE INVENTION

Animals, such as sheep and cattle, are now raised on farms and ranches world-wide. In order to identify their animals, certain ranchers, such as those residing in Europe, prefer to mark their animals with a dye as opposed to the traditional American system of branding.

Several considerations arise when using a marking system of identification. One such area involves toxicity. For example, any marking device or method should take into consideration its effect on the hide of the animals. Obviously, a device or method which does not cause a rash, ulcer or other type of blemish on the animal's hide is preferred.

Some animals are very sensitive to intrusion by humans, such as sheep. These type of animals tend to run away from humans who venture too close to them. In view of this, it would be advantageous to have a device which would propel a marking composition at long distances, e.g., from about ten to about twenty-five feet. This type of device would allow the animals to be easily marked, or identified, without disturbing the animals. In addition, animals which are potentially dangerous to humans, such as bulls, could be safely marked by use of such a device.

Many different types of systems are available for propelling liquid compositions from a container and onto a substrate. These systems may generally be divided into those which discharge liquids as aerosols and those which do not atomize the liquids but rather discharge the liquids as liquid streams.

The discharge of liquids as aerosols is most commonly utilized in the field of aerosolized paint systems. In these systems, an aerosol container is filled with a paint composition and a propellant wherein upon discharge the paint is atomized such that a smooth film is produced when the composition is applied onto a substrate. Generally, the container is held about twelve inches from the substrate, this being due to the relatively wide pattern of paint particle distribution experienced upon atomization. In addition, the relatively short "carry" or effective travel distance of the atomized paint particles from the container also acts to limit the distance the container should be held from the substrate.

One example of a device which purportedly assists in extending the length of aerosolized liquid travel is found in U.S. Pat. No. 2,908,446. This disclosure is directed toward a spray tube which is adapted for use in connection with pressurized dispensers of all types. The referenced tube is manufactured such that it may be inserted into the ejection orifice, or valve, of a dispenser which contains a gas propellant and a liquid. The length of this tube, which is not given in the reference, is such that the desired distance of travel of the ejected material is obtained. Further description relating to the specific distance of travel is similarly not present in the disclosure.

The presently known devices for the discharge of liquids as aerosols almost uniformly employ one or more liquid propellants, i.e., propellants which are gaseous at atmospheric pressure but which are in a liquid state when subjected to pressure such as that experienced in a typical aerosol container. Liquid propellants are primarily used due to the propellants' effect upon the liquid component in the container which is to be discharged. During discharge, the liquid propellant expands and thereby becomes gaseous due to its exposure to the lower (atmospheric) pressure. This expansion induces the aerosolization of the liquid component as it is discharged from the container.

Liquid propellants, however, suffer from a disadvantage in that they are extremely sensitive to changes in temperature. This sensitivity is exemplified in FIG. 3 wherein the pressure versus temperature of two liquid propellants, liquid propane and Freon 12 (E.I. DuPont de Nemours), is compared to that of a gaseous propellant, nitrogen. The results illustrate the relative stability of gaseous propellants over a variety of temperature ranges as opposed to the liquids relative instability.

A system of the second type, as categorized previously, which attempts to overcome these disadvantages is disclosed in U.S. Pat. No. 3,130,519. This reference is directed toward the injection feeding of plants wherein a liquid is dispensed from a pressurized container by way of a tube, this tube being appended to a valve. The propellant, which is a gas, serves to discharge the liquid from the container, through the tube, and into the vegetation in which the tube has been placed.

In view of the foregoing references, there exists a need for a device and method which are adapted for discharging a liquid component as a liquid stream at distances up to about twenty-five feet and which possesses the aforementioned desirable characteristics.

Accordingly, it is an object of the present invention to provide a device and method whereby a liquid may be discharged as a liquid stream at distances of up to about twenty-five feet.

A related object is to provide a device and method whereby at least about ninety weight percent of a liquid may be discharged as a liquid stream at a distance of at least about twenty feet.

A further object is to provide a device and method which are adapted for propelling a non-toxic, and non-irritating aqueous-based coating onto a substrate, such as an animal's hide, at the aforementioned distances.

A further related object is to provide a device and method which are adapted for propelling a liquid to the aforesaid distances while maintaining a relatively small dispersion pattern.

Another objective is to provide a device and method, the marking composition of which is less temperature-sensitive than conventional aerosol systems.

Yet another objective is to provide a device and method which allows relatively inaccessible areas to be marked by a marking composition which is propelled to distances of from about ten up to about twenty-five feet.

An additional objective is to provide a device and method which are adapted for propelling a non-flammable liquid to distances of from about ten to about twenty-five feet.

These and other objects and advantages of the present invention, as well as additional inventive features, will become apparent from the description which follows.

SUMMARY OF THE INVENTION

In accordance with the foregoing objectives, the present invention provides a device for discharging liquid as a stream comprising a container, liquid residing within said container, gas propellant residing within said container, means comprising an inlet and an outlet for controlling the discharge of said liquid from said container, said means being biased in a closed position and being movable to an open position in response to external pressure thereto, wherein the inlet of said means is in communication with said container, and a tube through which said liquid exits said system which is in communication with the outlet of said discharge means, said tube extending outwardly from said outlet, wherein the combination of said discharge means, said tube, and said propellant are adapted for discharging said liquid as a stream to a distance of from about ten to about twenty-five feet when said discharge means is moved into the open position.

A method for discharging a stream of liquid onto a substrate at long distances is also contemplated, this method comprising discharging liquid from a device, said device comprising a container, liquid residing within said container, gas propellant residing within said container, means comprising an inlet and an outlet for controlling the discharge of said liquid from said container, said means being biased in a closed position and being movable to an open position in response to external pressure thereto, wherein the inlet of said means is in communication with said container, and a tube through which said liquid exits said system which is in communication with the outlet of said discharge means, said tube extending outwardly from said outlet, wherein the combination of said discharge means, said tube, and said propellant are adapted for discharging said liquid as a stream to a distance of from about ten to about twenty-five feet when said discharge means is moved into the open position.

The present invention may best be understood with reference to the accompanying drawings wherein an illustrative embodiment is shown as well as to the following detailed description of the preferred embodiments.

DETAILED DESCRIPTION OF THE INVENTION

While the present invention will be described in connection with certain preferred embodiments, it is not intended that the present invention be so limited. On the contrary, it is intended to cover all alternatives, modifications, and equivalent arrangements as may be included within the spirit and scope of the invention as defined by the appended claims.

The preferred embodiments of the present invention are detailed below with reference to the drawings.

Figure 1:
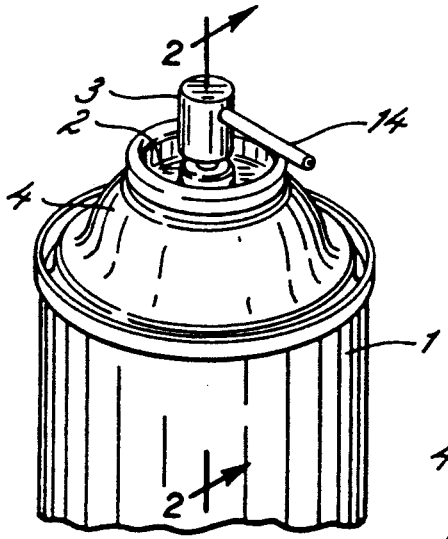
FIG. 1 is a perspective view of a preferred embodiment of the present invention.

FIG. 1 illustrates a long distance marking device embodying the present invention. It will be seen that the device comprises a pressurized container indicated generally at 1. While the container may be of any suitable design and may have any shape desired other than that shown, the container 1 illustrated is, by way of example, a commonly known pressurized container used for the containment of various liquids. Inasmuch as pressurized containers of this type are well known and readily available, these containers are preferred. The containers are generally made from metals, although other materials, such as plastics, may also be used provided they are inert in regard to the contents of the container.

Figure 2:
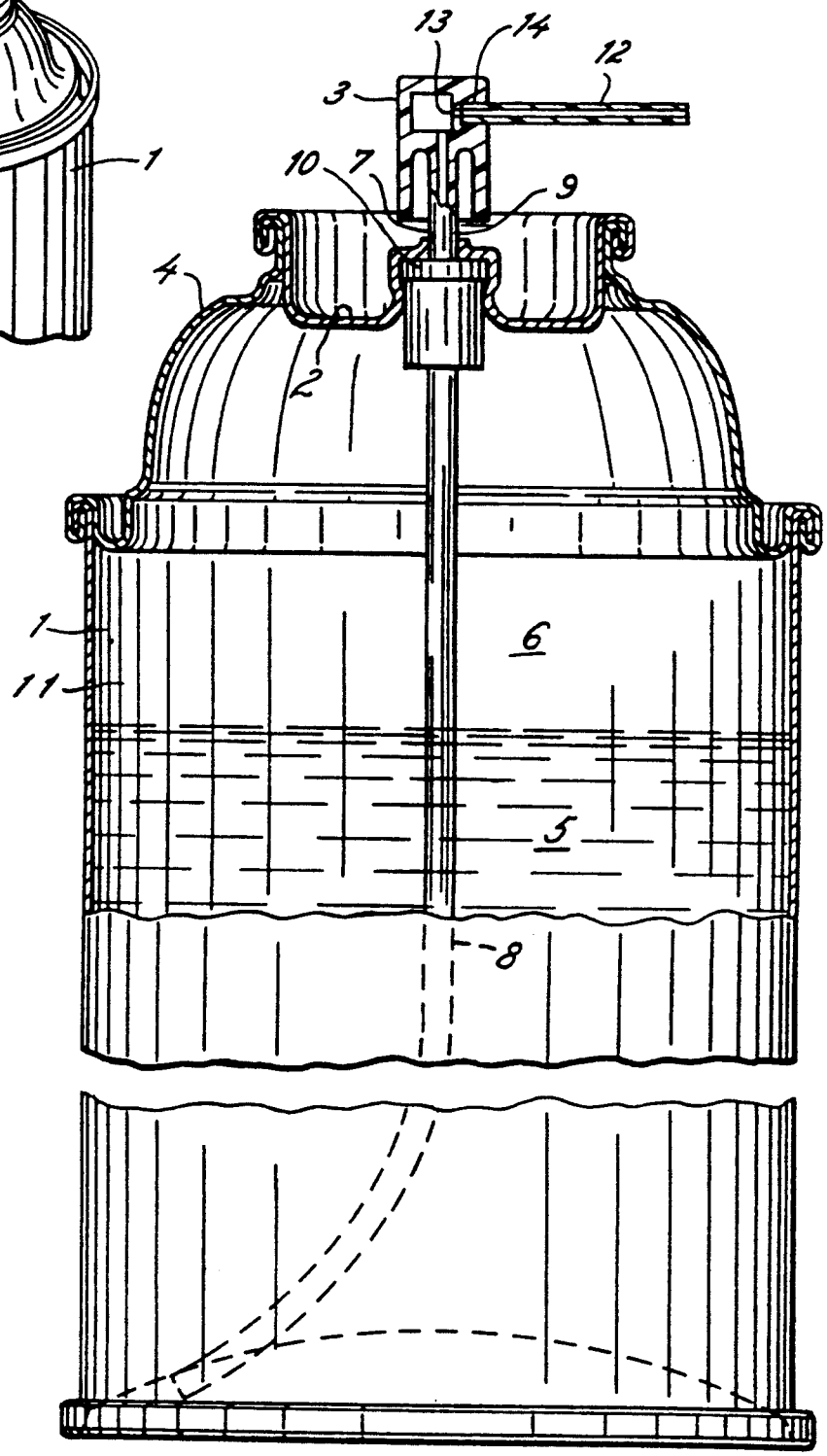
FIG. 2 is a vertical cross-section of FIG. 1 along section line A—A.
Figure 3:
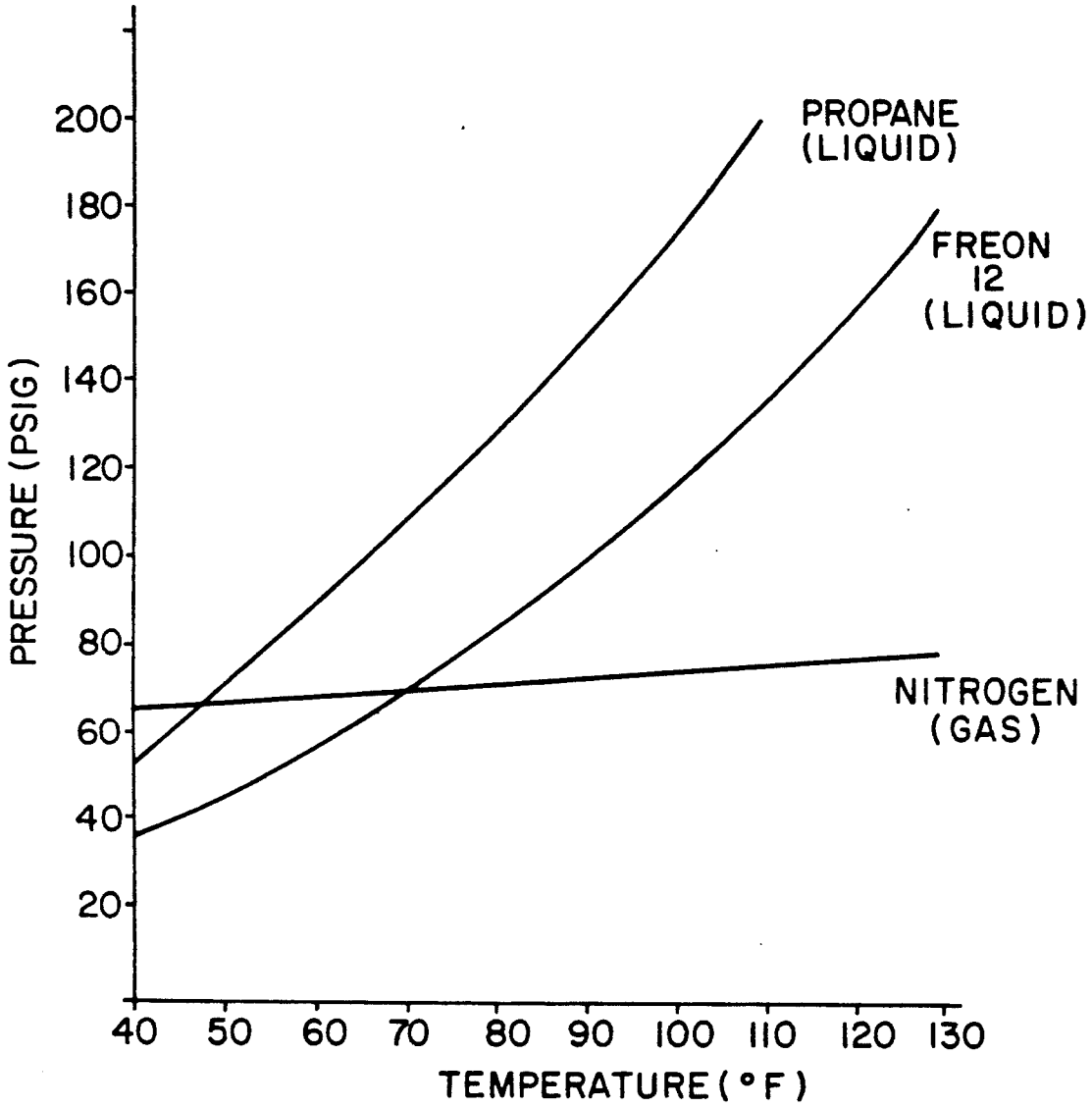
FIG. 3 is a graph which illustrates the relative stability of gaseous versus liquid propellants over a range in temperatures.
Figure 4:
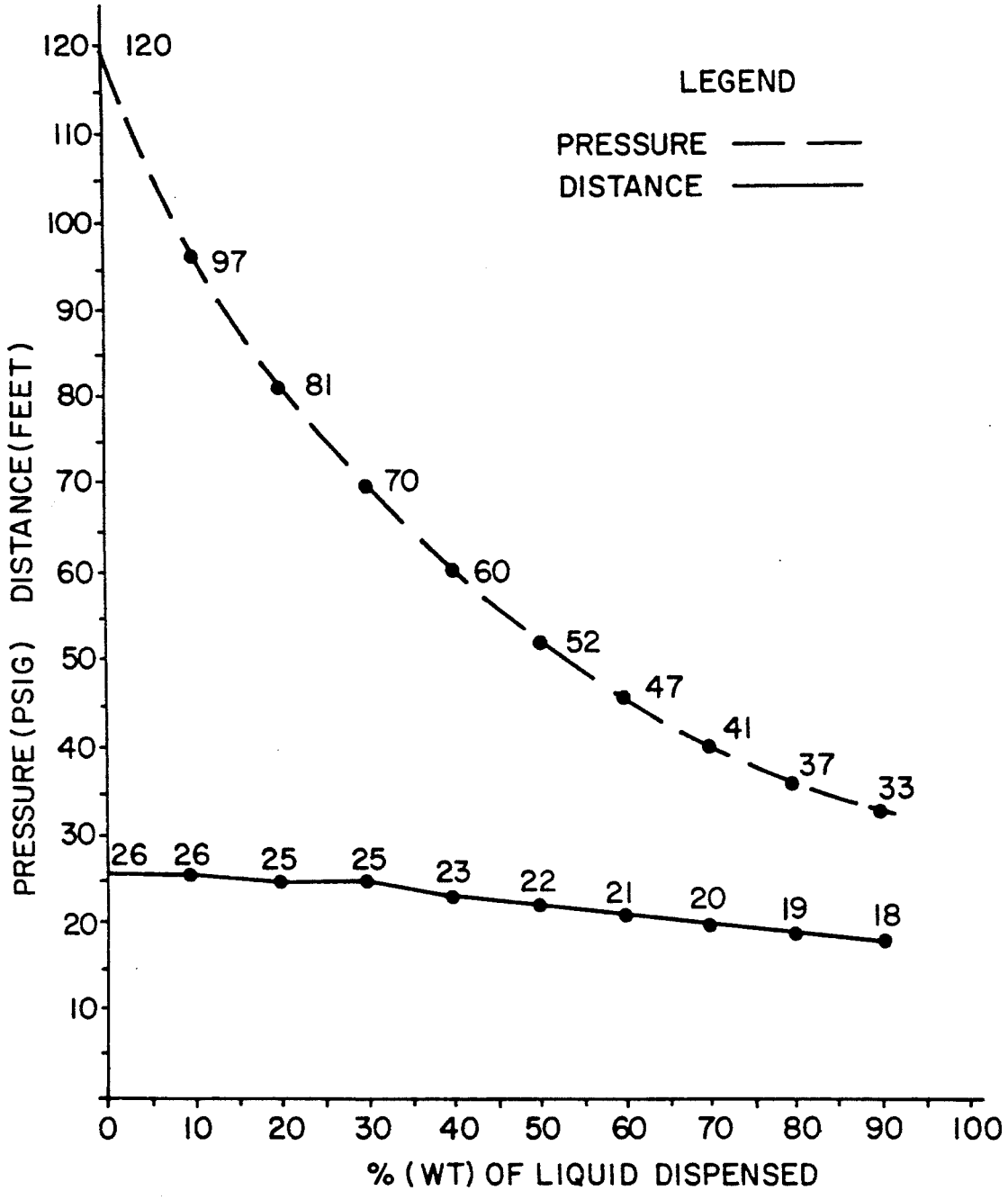
FIG. 4 is a graph which illustrates the results obtained upon discharge of the aerosol system described in Example 1.
Figure 5:
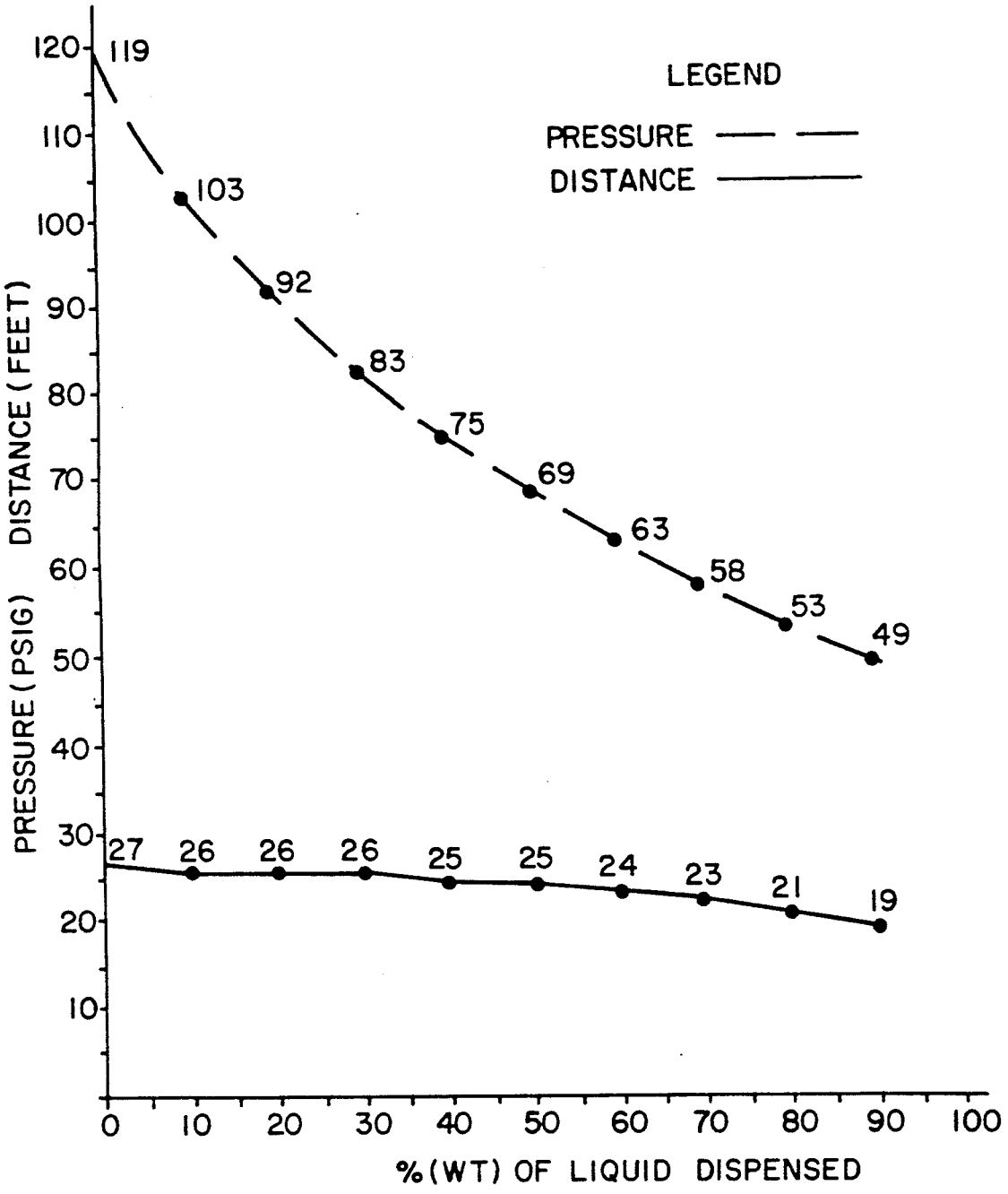
FIG. 5 is a graph which illustrates the results obtained upon discharge of the aerosol system described in Example 2.

The pressurized container is shown in greater detail in FIG. 2, the reference numerals of FIG. 1 being used in the same manner. The container 1 is closed at its top by discharge means which comprises a recessed valve mounting cup 2 and an actuator 3, said cup being secured to the domed top wall 4 at one end of the container body by means of a crimping operation. The main body portion of the container 1 contains a body of liquid 5 to be dispensed, the liquid being maintained under a pressure which is greater than atmospheric by means of one or more compressed gases 6. These gases generally reside in the space above the compressed liquid.

The use of a gas propellant in the present system assists in the discharge of a liquid as a stream, in contrast to an aerosol, from the container. Although any propellant which remains gaseous under the pressures experienced in the aforesaid containers is suitable for the present invention, the hydrocarbons, e.g., methane, ethane, nitrous oxide, carbon dioxide, argon, helium, as well as nitrogen and mixtures of these gases, are advantageously used. Nitrogen, due to its non-toxicity and non-flammability, is especially preferred.

The gas propellants described above will generally be present in an amount which is sufficient to evacuate the total amount of liquid present in the container. If a standard aerosol container is used, as discussed previously, the gas propellant should be present in an amount such that the initial pressure in the container ranges from about 30 to about 180 psig. Advantageously, the gas will be present to provide an initial container pressure ranging from about 50 to about 160 psig, and preferably the initial pressure will range from about 100 to about 140 psig. Of course, the degree of pressure exerted on a given container will vary in accordance with the container's pressure rating as well as the intended use of the container and liquid contained therein.

The mounting cup 2 as illustrated is a form of cup well known to those skilled in the art. This cup is adapted to close the open end of the container 1 through which the contents of the can are inserted during processing. The cup 2 is circular and has a central socket 7 which receives and retains a suitable actuator 3 which controls the discharge of liquid from the container.

The discharge means further comprises a dip tube 8 which extends downwardly from the body of a valve 10 into the container 1 such that substantially all of the liquid 5 in the container 1 is capable of being discharged from the container during use. Tube 8 is commonly a slightly bowed, flexible member made of a synthetic resin or plastic which is inert with respect to the contents of the container. The bowing of the tube 8 allows the tube to reach the liquid residing in the lowest part of the container. Thus, substantially all of the liquid residing within the container can be discharged, assuming an adequate supply of propellant, by providing a label on the exterior surface of the container indicating in which direction the actuator should be positioned during discharge.

In addition to the dip tube 8 and actuator 3, the discharge means further includes an actuator stem 9 which is hollow and projects from the body of actuator 3 which is secured within valve 10 by a friction fit operation. The actuator stem 9 is hollow and adapted for opening the valve by being moved toward the valve by external pressure, i.e., downwardly in the direction of the container 1. The valve is spring biased to a closed position. When the valve 10, is open, the liquid 5 is forced by the gas 6 in space 11 through the open end of the tube 8 and outward of the container 1 through the hollow stem 9. Interior portions of the valve are not shown in the drawings since they are well known and may be of any suitable design.

The pressurized container and the liquid discharge means attached thereto are generally well known in the art of packaging liquids in pressurized containers. As such, the details given herein are only those required for an understanding of the present invention. The particular container and actuator illustrated are merely exemplar of those that may be utilized in the present invention. Other suitable designs and constructions of these elements may also be used. For example, while the discharge means has been described as using a female valve and a male actuator, a male valve and female actuator may also be used successfully.

In addition to the previously described structure, the present invention includes a tube 12 which is adapted for insertion into the outlet of the discharge means. More specifically, and utilizing as an example the actuator 3, the tube 12 is in communication with outlet 13 of actuator 3. The tube 12 is preferably removably placed in communication with the outlet 13. This may be most conveniently accomplished by adapting the tube 12 and the actuator 3 such that the outer wall of the tube 12 will fit snugly into a socket in the actuator 3. The tube 12 should be in communication with the outlet 13 such that the liquid is discharged from outlet 13 and into the interior of said tube 12.

It is contemplated that the tube 12 and actuator 3 be manufactured as separate units, thereby enabling the tube 12 to be removed for cleaning and allowing for easy subsequent replacement of the tube 12. Of course, the tube may also be permanently attached to or integral with the actuator 3 if desired.

The relationship between the inside diameter of the tube 12, the length of tube 12, and, to a lesser extent container pressure, is also significant to the present invention. More precisely, unless these parameters are controlled within certain ranges, the distance the liquid will be propelled will be less than the desired range, i.e., up to about twenty-five feet. The distances that the liquid will travel in relation to the tube length and inside diameter have been obtained through experimentation. As such, a mathematical equation which relates these variables to one another has not been discovered. However, and in lieu thereof, it has been found that, generally, the inside diameter of the tube should range from about 0.025 to about 0.115 inches, advantageously from about 0.025 to about 0.050 inches, and preferably from about 0.035 to about 0.045 inches. In conjunction with these parameters, tube length should also be limited accordingly. Specifically, and in respect to the three ranges of inside tube diameter given above, the tube length should range from about 0.125 to about 8 inches, advantageously from about 0.5 to about 1 inches, and preferably from about 0.7 to about 0.8 inches. The aforesaid parameters, if used in the stated combinations, will result in a liquid being discharged to distances of between about ten and twenty-five feet at least until the interior pressure of a standard aerosol container reaches about 30 psig. Further, at least about ninety weight percent of the liquid will be discharged from the pressurized container.

Of course, it should be remembered that no matter what pressure is initially used in the container, the distance the liquid travels will eventually lessen as the container pressure decreases. The following experimental data is presented to illustrate the relationship between container pressure versus the distance the liquid is propelled and the amount of liquid dispensed. These graphs evidence one aspect of the present device and method, i.e., at least about ninety weight percent of liquids in an aerosol container will be propelled at distances ranging from about twenty to about twenty-five feet until the internal aerosol container pressure is lowered from its initial pressure of 120 psig to about 30 psig, in the case of a standard 16 ounce aerosol container.

EXAMPLE 1

This example utilized a standard 16 ounce aerosol container. Initially, the container was filled with 354.5 grams of liquid. Nitrogen was used as the propellant in a quantity sufficient to raise the internal container pressure to 120 psig (about 1.7 grams of nitrogen). The container was fitted with a C-10-128 valve and a 102-156-60 actuator. (Newman-Green, Inc., Addison, Ill.). A tube (Action Technology, Clinton, Ill.) having an inside diameter of 0.040 inches and a length of 0.75 inches was fitted onto the actuator. The following graph represents the results obtained with this combination upon discharge.

EXAMPLE 2

The previous Example was duplicated except that a 20 ounce container was utilized. Further, while the amount of liquid remained the same, an increased amount of propellant was included to maintain the pressure at 120 psig, i.e., 2.9 grams of nitrogen.

The significance of the length of tube 12 may be further illustrated by the following example. During a test of the present system which used the parameters given in the example of the previous paragraph, the tube was eliminated entirely. Upon discharge, the liquid was able to travel only about ten feet. Thus the present invention depends on the use of a tube having the aforesaid lengths and inside diameters in conjunction with the other elements of the present invention.

Further, it has been determined that the distance a liquid is propelled will lessen as the inside diameter of the tube varies from the stated range, either upwardly or downwardly. The same may be said for the length of the tube. This result also underscores the importance of the stated parameters to the present invention.

The liquid component of the present device may be any of a multitude of liquid compositions or combinations thereof so long as the liquid is sufficiently viscous to be propelled the desired distance. Thus, any type of aqueous-based or solvent-based liquid composition is suitable for use herein such as, for example, paints. Advantageously, aqueous-based paints or coatings which are non-toxic to animals and which do not irritate the animals hide are employed as marking compositions. Use of these coatings as the liquid of the present system allows an operator to apply a film or coating onto an object or surface which was heretofore inaccessible. Use of a non-toxic aqueous-based composition in combination with a non-toxic gas propellant, such as nitrogen, is preferred as this serves to further reduce the health hazards involved with the use of the present inventive device as compared to a system which uses a solvent-based composition.

Further, a composition which is non-flammable in nature is advantageously employed. The test for non-flammability used to analyze the present invention is the "Flame Projection Test" sanctioned by the CSMA. This test, which is used by the Consumer Products Safety Commission to evaluate aerosols, is well known to those of ordinary skill in the art. The test itself is described in the CSMA Aerosol Guide (7th ed. April, 1981) at page 14, this Guide being incorporated by reference herein. Generally, the test contemplates that an aerosol dispenser which is filled with the composition to be tested is shaken then positioned upright, unless the label specifies otherwise. The dispenser is subsequently placed six inches from a flame source in a draft-free area. The actual test is run for four seconds, i.e., the dispenser is discharged in the direction of the flame for four seconds. During discharge, the composition should be sprayed through the top one-third of the flame.

In assessing the results, page 18 of the CSMA Aerosol Guide deems a composition to be "Flammable" when the aerosol, during the "Flame Projection Test," produces a flame exceeding eighteen inches in length. All of the exemplified compositions herein are non-flammable.

When a water-based marking composition is to be used, the liquid, in addition to water, may contain one or more solids which are capable of being dispersed within the water. To assist in this dispersal, a dispersing agent such as a surfactant, e.g., cationic, anionic or non-ionic surfactants, may be employed in an amount sufficient to adequately disperse the solid or solids.

A polymer may also be included as the dispersed solid in the liquid. Generally, the polymer may be any type of filmforming polymer. Advantageously, the polymer will be selected from the group consisting of poly(vinyl acetate), acrylics, vinyl acrylics, and mixtures thereof. Especially preferred are the vinyl acrylics, such as Aquamac 468 (McWhorter, Inc., Carpentersville, Ill.) which is available as what McWhorter characterizes as an emulsion containing 55 wt. percent solids (polymers). If polymers are used, they may be present in any amount such that the discharge means and tube do not become clogged during discharge. Of course, if said means and tube become clogged during or after discharge, e.g., after use and storage for a period of time, they may simply be removed, cleaned, and replaced. Generally, the amount of polymer present in said liquid will range from about 1 to about 55 wt. percent of the liquid, advantageously from about 1 to about 10 wt. percent, and preferably from about 5 to about 7 wt. percent of the total liquid.

If a polymer is added, it may be advantageous to add an amount of surfactant such that an emulsion, rather than a dispersion, is formed. Typically, this is the form in which most aqueous-based paints and coatings are found, e.g., latex emulsions. Latex emulsions are also acceptable for use in the present system. Any suitable surfactant may be used to effect emulsification, preferably an alkylaryl polyether such as Triton CF-10 (Rohm & Haas). Generally, and although the amount of surfactant used will vary according to each individual emulsion, the component in this particular scenario will be present in an amount which adequately emulsifies the composition.

A pigment, fluorescent or otherwise, may be added to the liquid in order to add color to the liquid and color the substrate or animal hide onto which the liquid is applied. Pigment may be added either in the presence of the aforementioned polymer or in the absence thereof, this depending upon whether it is desired to form a continuous film on the substrate. Any type of pigment, e.g., inorganic, organic, metallic, and mixtures thereof, may be used in any amount, so long as the discharge means and tube do not become closed or blocked during discharge such that the desired travel distance cannot be reached. Additional amounts of surfactant may also be added with the pigment to obtain a dispersion. Preferably, the pigments are added as dispersions, such as those pigmented dispersions in the "WD" series available from the Daniel Products Company (Jersey City, N.J.).

If a fluorescent pigment is chosen, however, it may be desirable to utilize an associative thickener such as those described in copending U.S. patent application Ser. No. 462,824, filed Jan. 10, 1990, to Smrt, et. al., the entire disclosure of which is hereby incorporated herein by reference.

If a polymer is included in the liquid, one or more coalescing solvents may also be utilized to assist in the formation of a film from the polymer after discharge. Any suitable solvent which is adapted for producing a film from the polymer solids may be used. Advantageously, glycol ethers are used. Preferably these ethers include monoalkyl ethers of ethylene glycol, propylene glycol or diethylene glycol, such as propylene glycol methyl ether, ethylene glycol butyl ether, diethylene glycol mono butyl ether, and mixtures thereof. Generally, these solvents are present in an amount which will result in the formation of the preferred polymer film. The specific amount used in the present invention will typically range from about 1 to about 20 wt. percent of liquid, advantageously from about 2 to about 10 wt. percent, and preferably from about 3 to about 5 wt. percent of the total liquid composition. However, the use of an excess of such film-forming liquids are not desirable from a toxicity and animal hide irritability standpoint.

Corrosion inhibitors may also be included within the liquid. These components assist in preventing corrosion from forming on the interior of the container. Although any inhibitor may be used, even ammonia which serves to raise the pH of the liquid such that corrosive activity is reduced, Raybo 60 (Raybo Chemical Company) is preferred. The inhibitor will generally be present in a corrosion inhibiting amount, generally ranging from about 0.5 to about 1.5 wt. percent of the liquid.

The following examples illustrate several different liquid compositions which may be employed in the device and method of the present invention.

EXAMPLE 3

This example provides a method for producing a yellow pigmented liquid.

| | Amount (lbs) |
|---|---|
| A. Mix the following: | |
| AQUAMATIC 468 | 91 |
| WD-2002 White dispersion | 44 |
| WD-2412 Hansa yellow dispersion | 20 |
| Water | 695 |
| Raybo 60 | 9.3 |
| Diethylene glycol mono butyl ether | 2 |
| B. Mix the following in a separate container: | |
| Ethylene glycol | 9.3 |
| Xanthan gum | 2 |
| C. Combine mixtures A and B and mix for thirty minutes. | |

EXAMPLE 4

This example provides a method for producing a blue pigmented liquid. The components and procedure are the same as that presented in Example 3, except that 9.6 lbs. of WD-2228 Phthalo blue dispersion is used in place of the Hansa yellow dispersion and the water content is increased to a total of 703 lbs.

EXAMPLE 5

This example provides a method for producing a red pigmented liquid. The components and procedure are the same as that presented in Example 3, except that 2.3 lbs. of WD-2673 Red dispersion is used in place of the Hansa yellow dispersion, 20.3 lbs. of WD-2681 DNA orange dispersion is used in place of the white dispersion and the water content is increased to a total of 713 lbs.

EXAMPLE 6

This example provides a method for producing an orange pigmented liquid. The components and procedure are the same as that presented in Example 5, except that 2.3 lbs. of WD-2412 Hansa yellow dispersion is used in place of the Red dispersion and the water content is decreased to a total of 707 lbs.

EXAMPLE 7

This example provides a method for producing a green pigmented liquid. The components and procedure are the same as that presented in Example 3, except that 5 lbs. of WD-2412 Hansa yellow dispersion and 10.4 lbs. of Phthalo green dispersion are used in place of the Phthalo blue dispersion and the water content is decreased to 699 lbs.

It is contemplated that other components may be added to the liquid such as alcohols, thickeners, plasticizers, leveling agents, and the like without affecting the nature of the present invention or its operation. Toxicity and nonirritability of the resulting liquid composition should be taken into consideration in view of the particular intended application.

I claim:

1. A device for propelling a non-aerosolized liquid stream to long distances comprising a container, a liquid residing within said container, a propellant residing within said container which remains gaseous when subjected to pressure within said container, valve means comprising an inlet and an outlet for controlling the discharge of said liquid from said container, said valve means being biased in a closed position and being movable to an open position in response to external pressure thereto, wherein the inlet of said valve means is in communication with said container such that said liquid can flow from said container through said valve means, and an actuator in communication with the outlet of said valve means such that said liquid can flow from the outlet of said valve means through said actuator and outwardly from said device, said actuator comprising a cylindrical tube having a length and an outlet at one end of said tube, wherein the inside diameter of said tube remains constant along its length and is equal to the diameter of the tube outlet from which the liquid exits the device, wherein the combination of said valve means, said actuator, and said propellant cooperate to discharge said liquid from said container as a non-aerosolized liquid stream to a distance of from about ten to about twenty-five feet when said valve means is moved into the open position.

2. The device of claim 1, wherein said liquid comprises a dispersion comprising water, a surfactant, and a dispersible solid.

3. The device of claim 2, wherein said dispersible solid is a polymer.

4. The device of claim 2, wherein said dispersible solid is present in said dispersion in an amount such that said valve means and said actuator do not become blocked by said dispersion during discharge.

5. The device of claim 3, wherein said polymer is a vinyl acrylic polymer.

6. The device of claim 3, wherein said polymer is present in an amount ranging from about 1 to about 55 wt. percent of said liquid.

7. The device of claim 3, wherein said polymer is selected from the group consisting of poly(vinyl acetate), acrylics, vinyl acrylics, and mixtures thereof.

8. The device of claim 7, wherein said polymer is present in an amount ranging from about 1 wt. percent to about 10 wt. percent of liquid.

9. The device of claim 7, wherein said polymer is present in an amount ranging from about 5 wt. percent to about 7 wt. percent of liquid.

10. The device of claim 1, wherein said gas propellant is selected from the group consisting of nitrogen, methane, ethane, carbon dioxide, nitrous oxide, argon, helium, and mixtures thereof.

11. The device of claim 1, wherein said gas propellant is present in an amount such that the internal pressure of said container ranges from about 30 to about 180 psig.

12. The device of claim 11, wherein the inside diameter of said tube ranges from about 0.025 to about 0.115 inches and the tube length from about 0.125 to about 8 inches.

13. A device for propelling a non-aerosolized liquid stream to long distances comprising a container, a liquid residing within said container comprising water, a surfactant, a polymer, a pigment, and a coalescing solvent, said polymer being selected from the group consisting of poly (vinyl acetate), acrylics, vinyl acrylics, and mixtures thereof, a propellant residing within said container which remains gaseous when subjected to pressure within said container and which discharges said liquid from said container, said propellant being a member selected from the group consisting of nitrogen, carbon dioxide, nitrous oxide, argon, helium, and mixtures thereof, valve means comprising an inlet and an outlet for controlling the discharge of said liquid from said container, said valve means being biased in a closed position and being movable to an open position in response to external pressure thereto, wherein the inlet of said valve means is in communication with said container, such that said liquid can flow from said container through said valve means, and an actuator in communication with the outlet of said valve means such that said liquid can flow from the outlet of said valve means through said actuator and outwardly from said device, said actuator comprising a cylindrical tube having a length and an outlet at one end of said tube, wherein the inside diameter of said tube remains constant along its length and is equal to the diameter of the tube outlet from which the liquid exits the device, wherein the combination of said valve means, said actuator, and said propellant cooperate to discharge said liquid from said container as a non-aerosolized liquid stream to a distance of from about ten to about twenty-five feet when said valve means is moved into the open position.

14. The device of claim 13, wherein said gas propellant is present in an amount such that the internal pressure of said container ranges from about 100 to about 160 psig.

15. The device of claim 14, wherein the inside diameter of said tube ranges from about 0.025 to about 0.050 inches and the tube length from about 0.5 to about 1 inches.

16. The device of claim 13, wherein said polymer is present in an amount ranging from about 5 wt. percent to about 7 wt. percent of said liquid, said coalescing solvent is present in an amount ranging from about 3 wt. percent to about 5 wt. percent of said liquid, said propellant is present in an amount such that the internal pressure of said container ranges from about 100 to about 140 psig, said tube protrudes from about 0.7 to about 0.8 inches from the outlet of said discharge means and the inside diameter of said tube ranges from about 0.035 to about 0.045 inches such that said liquid is discharged at a distance of from about ten to about twenty-five feet.

17. The device of claim 1, further comprising a container corrosion inhibitor.

18. The device of claim 2, wherein said dispersible solid is a pigment.

19. The device of claim 3, further comprising a coalescing solvent.

20. The device of claim 19, wherein said coalescing solvent is selected from the group consisting of lower monoalkyl ethers of ethylene glycol, lower monoalkyl ethers of propylene glycol, lower monoalkyl ethers of diethylene glycol, and mixtures thereof.

21. The device of claim 1, wherein said liquid is non-flammable during discharge.

22. The device of claim 1, wherein at least about ninety weight percent of said liquid can be removed from the device during discharge.

* * * * *